US008887793B2

(12) United States Patent
Massey

(10) Patent No.: US 8,887,793 B2
(45) Date of Patent: Nov. 18, 2014

(54) SCREEN ATTACHMENT METHOD FOR LINEALS

(71) Applicant: Milgard Manufacturing Incorporated, Taylor, MI (US)

(72) Inventor: Victor Massey, Orting, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 75 days.

(21) Appl. No.: 13/724,289

(22) Filed: Dec. 21, 2012

(65) Prior Publication Data

US 2014/0041324 A1 Feb. 13, 2014

Related U.S. Application Data

(63) Continuation-in-part of application No. 13/569,449, filed on Aug. 8, 2012.

(51) Int. Cl.

| | |
|---|---|
| ***A47G 5/00*** | (2006.01) |
| ***E06B 5/10*** | (2006.01) |
| ***E06B 3/26*** | (2006.01) |
| ***E06B 9/01*** | (2006.01) |
| ***E06B 9/52*** | (2006.01) |

(52) U.S. Cl.

CPC ... *E06B 5/10* (2013.01); *E06B 3/26* (2013.01); *E06B 9/01* (2013.01); *E06B 9/52* (2013.01); *E06B 2009/527* (2013.01)

USPC ..... 160/371; 160/369; 292/163

(58) Field of Classification Search

CPC ..... E06B 9/52; E05C 1/04; E05C 1/10

USPC ..... 160/369, 371, 90; 292/137, 163, 175, 292/67, DIG. 63, DIG. 61; 49/57, 463, 465, 49/62

See application file for complete search history.

(56) References Cited

U.S. PATENT DOCUMENTS

| | | | | |
|---|---|---|---|---|
| 410,217 | A | 9/1889 | Stone | |
| 1,189,969 | A | 7/1916 | Kimball | |
| 3,122,797 | A | 3/1964 | Valfredo | |
| 5,450,701 | A | 9/1995 | White | |
| 5,787,657 | A | 8/1998 | Librande et al. | |
| 6,050,618 | A | 4/2000 | Tieu | |
| 6,109,331 | A * | 8/2000 | Story, Jr. | 160/371 |
| 2010/0244465 | A1 | 9/2010 | De Mola | |
| 2013/0093198 | A1 * | 4/2013 | Liang et al. | 292/163 |

FOREIGN PATENT DOCUMENTS

| | | |
|---|---|---|
| JP | 200707341 | 10/2005 |

* cited by examiner

*Primary Examiner* — Blair M Johnson
(74) *Attorney, Agent, or Firm* — Rathe Lindenbaum LLP

(57) ABSTRACT

A window screen assembly comprising a screen frame including a screen lineal and a lip portion, the screen lineal including an aperture and a screen channel, a screen member secured in the screen channel. The assembly also has a slide assembly comprising a shield attached to the screen lineal, mounted into the aperture, a top slide attached to the shield, movable relative to the screen frame from an engaged position to a disengaged position along a given linear axis. The slide comprises a cap, a post attached to the cap, a ramp attached to the post. The shield has at least one shield springs embedded in the shield. The window screen assembly is configured to be removably secured to an architectural member.

17 Claims, 16 Drawing Sheets

SCREEN ATTACHMENT METHOD FOR LINEALS

CROSS-REFERENCE TO RELATED PATENT APPLICATIONS

This application is a continuation-in-part of application Ser. No. 13/569,449 filed Aug. 8, 2012 entitled Screen Attachment Handle with Latch which is incorporated herein by reference in its entirety.

BACKGROUND

The present invention relates generally to the field of window screen latch mechanisms and, more particularly, to spring-biased screen latch. Screen latches are used to secure a screen to a window frame so that the screen may be installed and removed depending on the season and desired use by an occupant.

SUMMARY

In one embodiment, a window screen assembly includes a screen frame and a spring biased latch assembly. The screen frame includes at least one lineal member having a screen channel and at least one aperture positioned between a first end and a second end of the lineal member. The screen member is secured in the screen channel. The spring biased latch assembly is located within the aperture and includes a latch portion biased in a direction away from the screen channel

DETAILED DESCRIPTION OF THE EXAMPLE EMBODIMENTS

Figure 1:
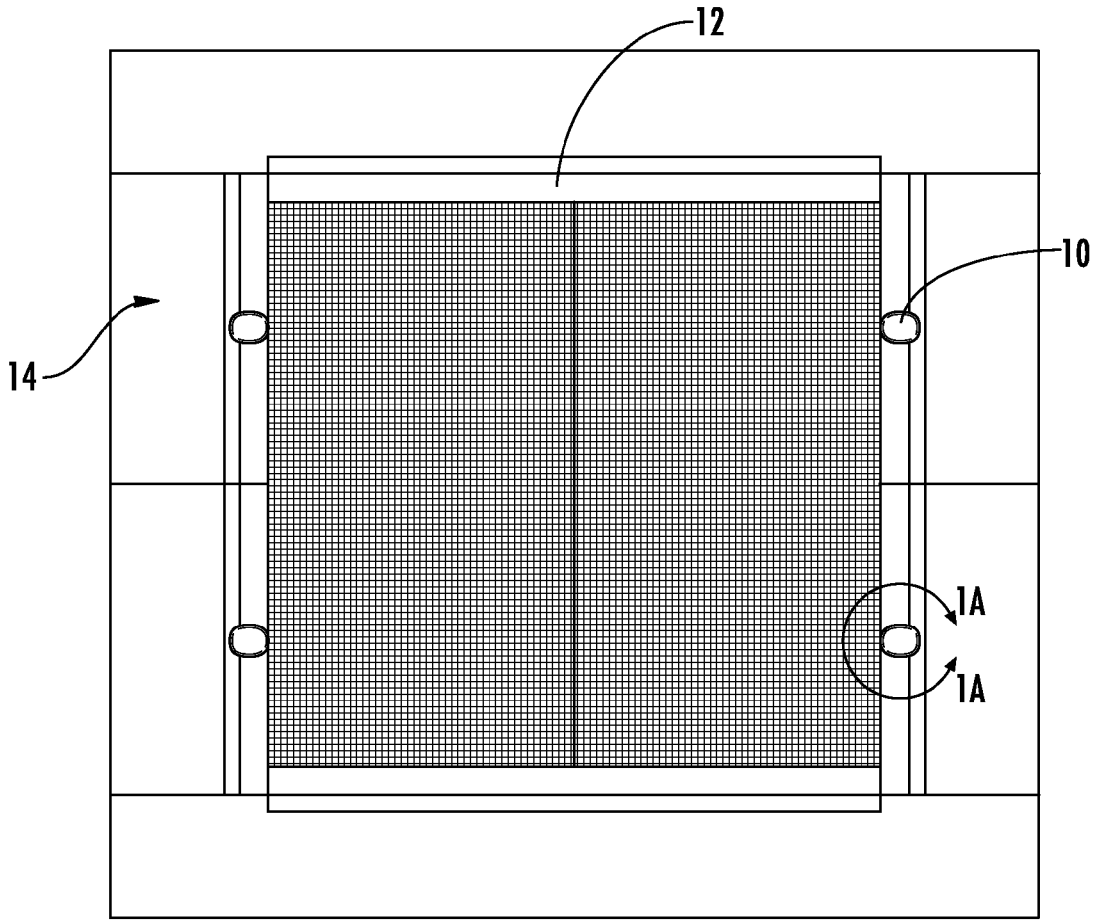
FIG. 1 is an isometric partial view of a latch mechanism.
Figure 1A:
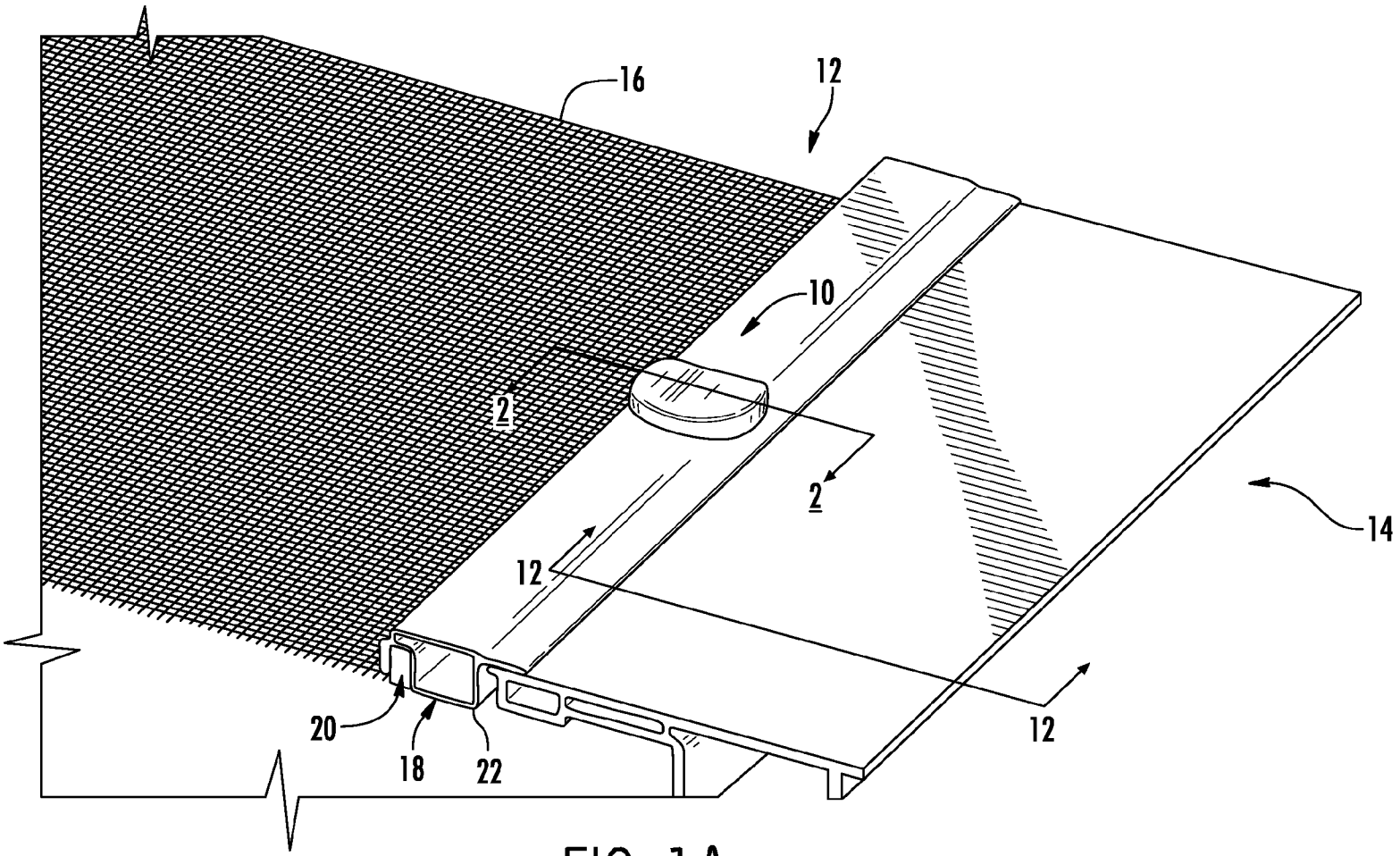
FIG. 1A is a cross-sectional view of the latch mechanism taken generally about line 1A-1A of FIG. 1.

Referring to FIG. 1, a latch mechanism 10 is configured to removably secure a screen assembly 12 to an architectural frame 14 such as a window frame or door frame. Screen assembly 12 comprises a flexible membrane or screen 16 attached to a screen frame 18 with an attachment device or spline 20. Screen frame 18 includes a screen frame member or lineal 22. Screen assembly 12 when secured to architectural frame 14 separates the inside of a building with the outside of the building, or separates one part of an architectural structure from another part of the architectural structure. At least one latch mechanism 10 is coupled to lineal 22 to removably secure screen assembly 12 to architectural frame 14.

Figure 4:
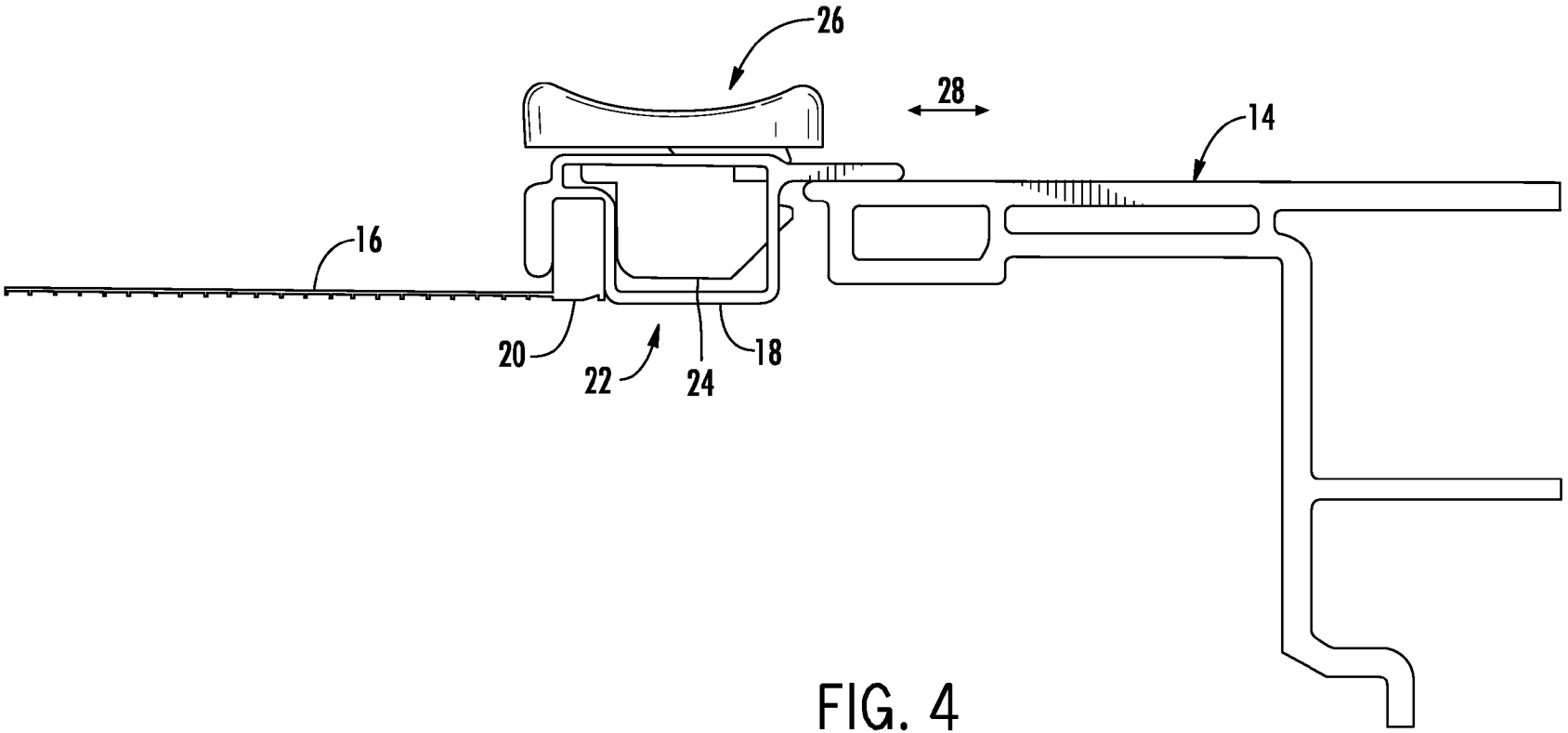
FIG. 4 is a cross-sectional view of the latch mechanism of FIG. 2 in a locked position.
Figure 5:
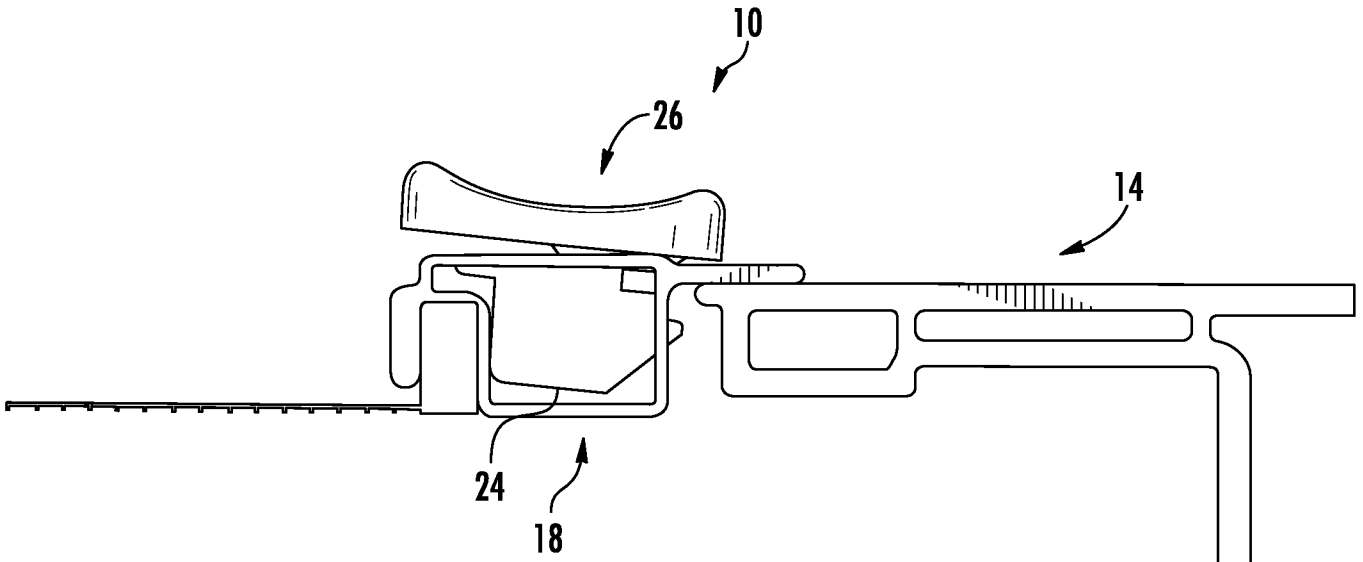
FIG. 5 is a cross-sectional view of the latch mechanism of FIG. 2 in a rocked position.

Latch mechanism 10 may be used to secure a screen to a window or door. Typically, a window or door with a screen is installed in a vertically-oriented, exterior wall of a building structure separating an inside space from an outside space. While latch mechanism 10 may be used to secure a screen assembly to different types of windows and doors and in different locations and orientations on the structure, latch mechanism 10 will be described relative to a screen assembly secured to a window in an exterior wall of a structure with the screen assembly 12 being secured to the frame from the inside of the structure. The direction "up" or "upward" is used to reference a general vertically-oriented vector direction away from the force of gravity while the term "down" or "downward" is used to reference a general vertically-oriented vector direction toward the force of gravity. The direction "in" or "inward" is used to reference a general horizontally-oriented vector direction toward the inside of the structure. The direction "out" or "outward" is used to reference a general horizontally-oriented vector direction toward the outside of the structure. The term "front" or "inside" is used to describe the surface that a person would see facing the window from the inside of a building structure while the term "rear" or "outside" is used to describe the surface that a person would see facing the window from the outside of a building structure. With respect to architectural frame 14, the term "inboard" is used to describe the area inside the form or shape created by architectural frame 14, while the term "outboard" is used to describe the area outside the form created by architectural frame 14. "Inboardly" and "outboardly" define directions moving toward the inboard area or toward the outboard area, respectively Referring to FIGS. 2 and 3, latch mechanism 10 includes a bolt or latch member 24 and a handle 26 that are movably coupled to lineal 22 in a sliding motion along a vector direction 28 between an engaged position and a disengaged position with respect to architectural frame 14. The term vector 28 will include a line in both directions. In one embodiment a plurality of latch mechanisms 10 are located about screen assembly 12. Referring to FIG. 4, Latch mechanism may be rocked to a locked position when latch mechanism 10 is in the disengaged position to maintain latch mechanism 10 in the disengaged position when a user releases handle 26. Referring to FIG. 5, latch mechanism 10 may be rocked to an unlocked position to allow latch mechanism 10 to move to the engaged position.

Latch mechanism 10 provides easy operation for removably securing screen assembly 12 to architectural frame 14. Screen assembly 12 is secured or attached to architectural frame 14 from inside the structure with handle 26 also facing inside the structure and facing a user. To attach screen assembly 12 to architectural frame 14, a user positions screen assembly 12 into alignment with the corresponding opening in architectural frame 14 and exerts a force on screen lineal members 22 toward architectural frame 14 in the outside direction. The position of handle 26 automatically adjusts as latch member 24 engages architectural frame 14.

As will be described in detail below, handle 26 of latch mechanism 10 responds to the force of the screen being pressed into architectural frame 14 by sliding along vector 28 generally inboardly within lineal 22 as latch member 24 engages architectural frame 14, and then moves outboardly once latch member 24 clears architectural frame 14. Handle 26 ceases movement in the engaged position, correlating to completion of attachment of screen assembly 12 to architectural frame 14. To detach screen assembly 12 from frame 14, the user manipulates handle 26. First, the user slides handle 26 inboardly to the disengaged position. Secondly, the user rocks handle 26 about an axis 34 substantially parallel to or co-linear with a longitudinal axis 44 of lineal 22. As a result latch mechanism is pivoted to the locked position. With latch member 24 in the locked position, the user ceases manipulation of handle 26 and removes screen assembly 12 from architectural frame 14. Latch mechanism 10 will remain in the locked position until the user manipulates handle 26 by rocking handle 26 to the unlocked position thereby releasing latch mechanism 10 from the locked position. Prior to reattachment of screen assembly 12 to architectural frame 14, the user preferably releases latch mechanism 10 from locked position by rocking handle 26 in the opposing direction that the handle was rocked to lock the latch mechanism, thereby pivoting latch mechanism 24 in the opposing direction about axis 34 to the unlocked position. When released, latch member 24 and handle 26 is spring biased to the extended engaged position in preparation for reattachment of screen assembly 12 to architectural frame 14. In the event the user fails to rock handle 26 to unlock latch member 24 prior to commencement of reattachment, the user may alternatively unlock latch mechanism 10 after positioning screen assembly 12 into alignment with architectural frame 14.

Figure 3:
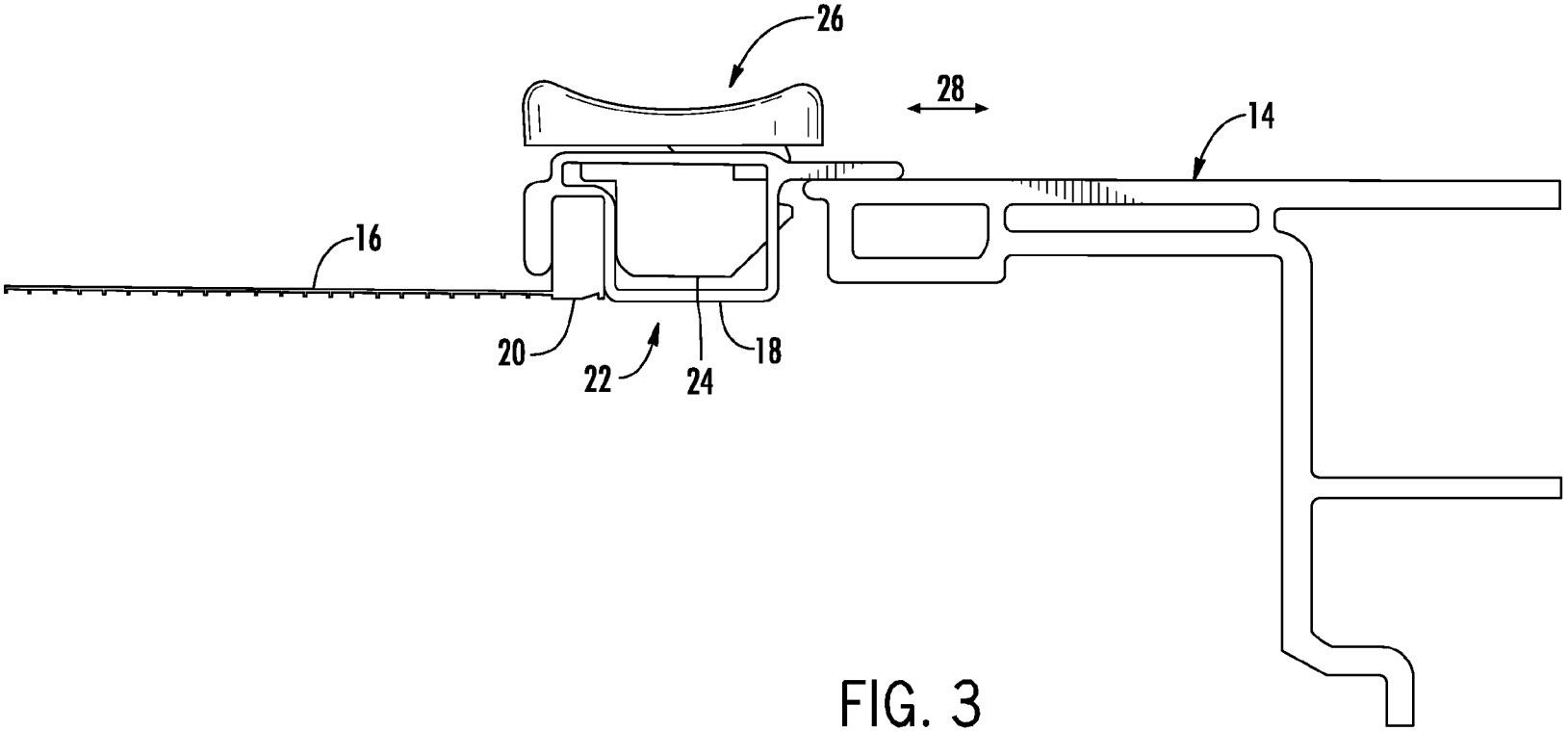
FIG. 3 is a cross-sectional view of the latch mechanism of FIG. 2 in a disengaged position.

Referring to FIG. 3 flexible membrane or screen 16 provides a separation between two areas, including between two rooms or areas within a building structure and between the inside of a building structure and the outside of the building structure. Screen 16 may be constructed of a material with characteristics including, but not limited to, the following: permeable, impermeable, metallic, plastic, fabric, opaque, translucent, transparent, woven. Screen 16 may also include decorative elements including, but not limited to, designs and artwork. In one embodiment, screen 16 may be of a permeable material and located in an exterior building wall, thereby allowing air circulation between the inside and outside of the building. In another embodiment, screen 16 may be of a permeable material and located in an interior building wall, thereby allowing air circulation between two rooms within a building. In yet another embodiment, screen 16 may be of a translucent material with an included artistic design, thereby providing visual and aesthetically-pleasing privacy between two rooms within a building.

Screen frame 18 is a substantially rigid component or structure, including at least one lineal 22, configured to receive and support screen 16 and to interface with architectural frame 14. Screen frame 18 has a shape corresponding to the shape of architectural frame 14 and a configuration to accept screen 16 and spline 20 such that screen 16 spans the area contained within the shape or inboard area of screen frame 18. In one embodiment, screen frame 18 may include four lineals, creating a rectangular or square shape. In another embodiment, screen frame 18 may include three lineals, creating a triangular shape. In other embodiments, screen frame 18 may include other quantities of lineal 22, creating other shapes, including, but not limited to, pentagon, hexagon and octagon.

Screen attachment or spline 20 removably secures screen 16 to screen frame 18. Spline 20 comprises a component of compressible material of a substantially consistent cross-sectional area and of a length sufficient to circumnavigate the perimeter of the shape of screen frame 18 proximate the inboard area. Spline 20 retains screen 16 to screen frame 18 by compressive fitment of spline 20 into an area of screen frame 18 with a cross-sectional area that is smaller than the cross-section of spline 20. Spline 20 and screen 16 are removable from frame 18 substantially without damage to spline 20, screen 16 or frame 18.

Figure 6:
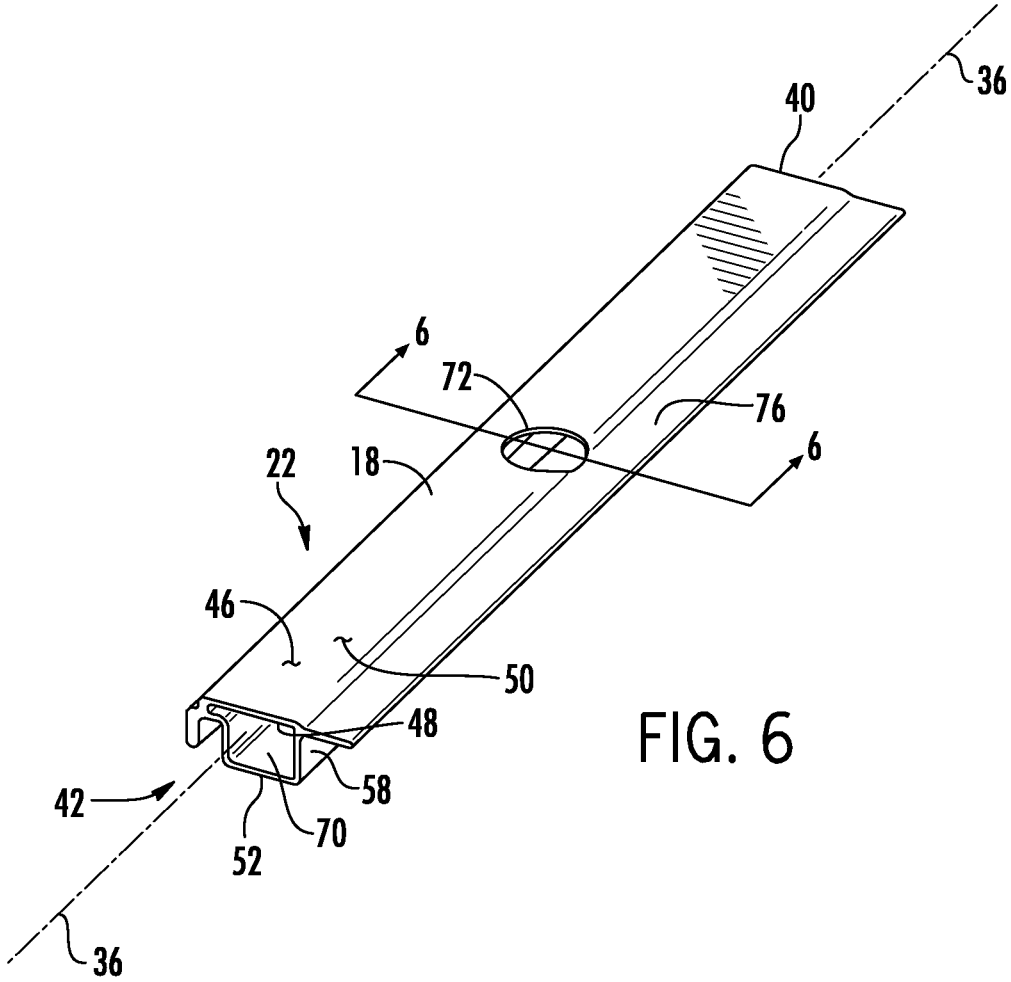
FIG. 6 is an isometric view of a lineal component of the latch mechanism of FIG. 1.
Figure 7:
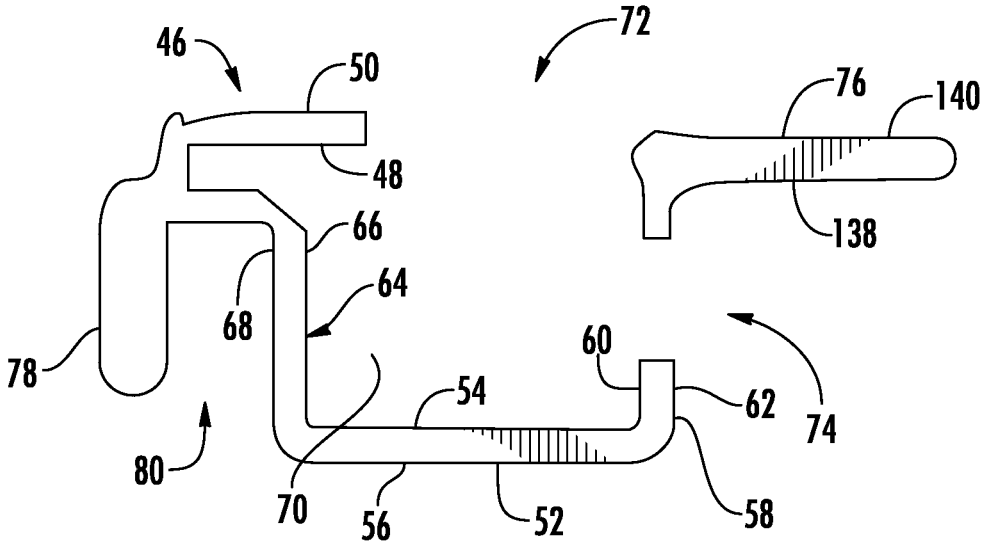
FIG. 7 is a cross-sectional view of the lineal component of FIG. 6 taken along lines 7-7 of FIG. 6.

Referring to FIGS. 6 and 7, screen member or lineal portion or lineal 22 is a substantially rigid component of screen frame 18 configured to removably secure latch mechanism 10 and to engage with architectural frame 14. Lineal 22 includes a first end 40, a second end 42 and a longitudinal axis 36 extending between first end 40 and second end 42. Lineal 22 comprises members that extend between first end 40 and second end 42 including a first wall 46, the first wall 46 includes a first or interior surface 48 and a second opposing front or exterior surface 50; a second wall 52 spaced from and parallel to first wall 46. Second wall 52 includes a first or interior surface 54 and a second or exterior surface 56; a third wall 58, includes a first or interior surface 60 and a second or exterior surface 62. A fourth wall 64 is spaced from and parallel to third wall 58, the fourth wall 64 includes a first or interior surface 66 and a second or exterior surface 68. Third wall 58 and fourth wall 64 extend generally perpendicular to first wall 46 and second wall 52. A cavity 70 is formed by the first wall 46, second wall 52, third wall 58 and fourth wall 64. A first opening 72 extends through first wall 46 and a second opening 74 extends through third wall 58 proximate to first opening 72. First opening 72 and second opening 74 are located intermediate first end 40 and second end 42. In one embodiment, first opening 72 and second opening 74 each comprise a circular opening formed from a standard drill bit. In another embodiment, at least one of first opening 72 and second opening 74 may be noncircular or may be formed by an alternate machining method.

Lineal 22 also includes a flange or lineal extension 76 extending from first wall 46. Lineal extension 76 includes a first side 138 proximate third wall 58 and an opposing second side 140 distal third wall 58. In one embodiment lineal extension 76 is substantially coplanar with first wall 46. In another embodiment, lineal extension 76 may be located in a plane spaced from and substantially parallel to first wall 46. A spline flange 78 extends from first wall 46 and is substantially perpendicular to first wall 46. Spline flange 78 is spaced from and substantially parallel to fourth wall 64. A spline groove 80 is formed between spline flange 78 and fourth wall 64. Spline groove 80 is configured to receive a peripheral portion of screen 16 and spline 20. Spline groove 80 is external to cavity 70 and distal first opening 72, second opening 74, and lineal extension 76. A retaining groove or retaining channel 82 is extends from cavity 70 and is formed by first wall 46 and a fifth wall 84 extending between fourth wall 64 and spline flange 78.

Figure 8:
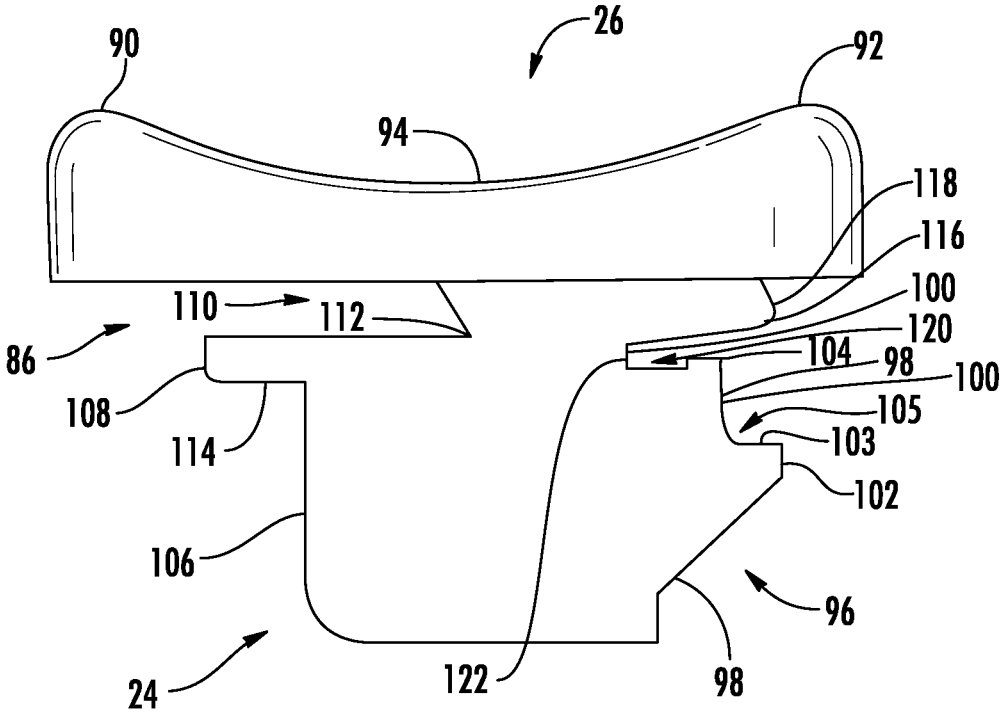
FIG. 8 is a side view of a latch component of the latch mechanism of FIG. 1.

Referring to FIG. 8, latch mechanism 10 is configured to be removably coupled to lineal 22 and to engage with architectural frame 14. Latch mechanism 10 includes latch member 24, handle 26, and a retaining portion 86. Retaining portion 86 is intermediate latch member 24 and handle 26. A Spring member or spring 88 extends from latch member 24. The latch member 24, handle 26, and retaining portion 86 are secured together in a fixed arrangement. In one embodiment, latch member 24, handle 26, and retaining portion 86 comprise a unitary body of solid material. In another embodiment, latch member 24, handle 26, and retaining portion 86 may be individual components permanently secured to one another. In yet another embodiment, at least one of latch member 24, handle 26, and retaining portion 86 may be constructed of nonsolid material. In one embodiment, one or more of latch member 24, handle 26, and retaining portion 86 may be constructed of a resilient material including, but not limited to, a polymer material.

Handle 26 is a component configured for manipulation by a user to create movement in vector direction 28 and about rocking axis 34. Handle 26 includes a first end or spring end 90 and a second end or engagement end 92 and a thumbrest surface 94 intermediate first end 90 and an opposing second end 92. In one embodiment, surface 94 may be concave or recessed relative to ends 90 and 92. In another embodiment, surface 94 may have another shape relative to ends 90 and 92, the shape including, but not limited to, flat.

Latch member 24 is a component configured to engage with architectural frame 14. Latch member 24 is dimensionally configured to fit substantially within cavity 70. Latch member 24 comprises a first side or engagement region 96, the engagement region 96 includes a beveled surface or ramp 98 terminating at a nose 102, a horizontal surface 103 extends from nose 102 to a substantially vertical catch surface 100. Horizontal surface 103 and vertical catch surface 100 form a notch 105. Catch surface 100 terminates at an upper end with a substantially horizontal surface 104. Latch member 24 also includes a second side or spring wall 106. Engagement region 96 and spring wall 106 are configured on opposing sides of latch member 24 in a fixed arrangement. Movement of spring wall 106 results in correlating movement of engagement region 96.

Retaining portion 86 is configured in combination with latch member 24 and handle 26 to retain latch mechanism 10 in a given position relative to lineal 22. Retaining portion 86 comprises a first end or retaining member 108 adjacent extending from spring wall 106 in a direction away from engagement region 96. A guide groove 110 is formed between a bottom of handle 26 and retaining member 108. Retaining member 108 includes an upper surface 112 facing handle 26 and an opposing bottom surface 114.

Retaining portion 86 further includes a retaining flange 116 extending from the bottom of handle 26. Retaining flange 116 includes an engagement surface 118 extending from the bottom of handle 26 to the bottom of retaining flange 116. Engagement surface 118 may be perpendicular to the bottom of handle 26 or may form an angle with respect the bottom of handle 26 forming a lock notch 119. A groove 120 is formed between the bottom of retaining flange 116 and upper surface 104 of latch member 24.

Spring member 88 is a component configured to bias latch mechanism 10 in vector direction 28 into engagement with architectural frame 14. Spring 88 is attached to spring region 106. Spring region 106 may include a bore or other fastening mechanism to secure or locate spring 88 to latch member 24. The spring 88 extends substantially perpendicular from surface 106. In one embodiment spring 88 is a compression spring that creates a force against surface 106 when spring 88 is compressed, resulting in a biasing force of latch member 24 in a vector direction 28 from spring region 106 toward engagement region 96.

Figure 9:
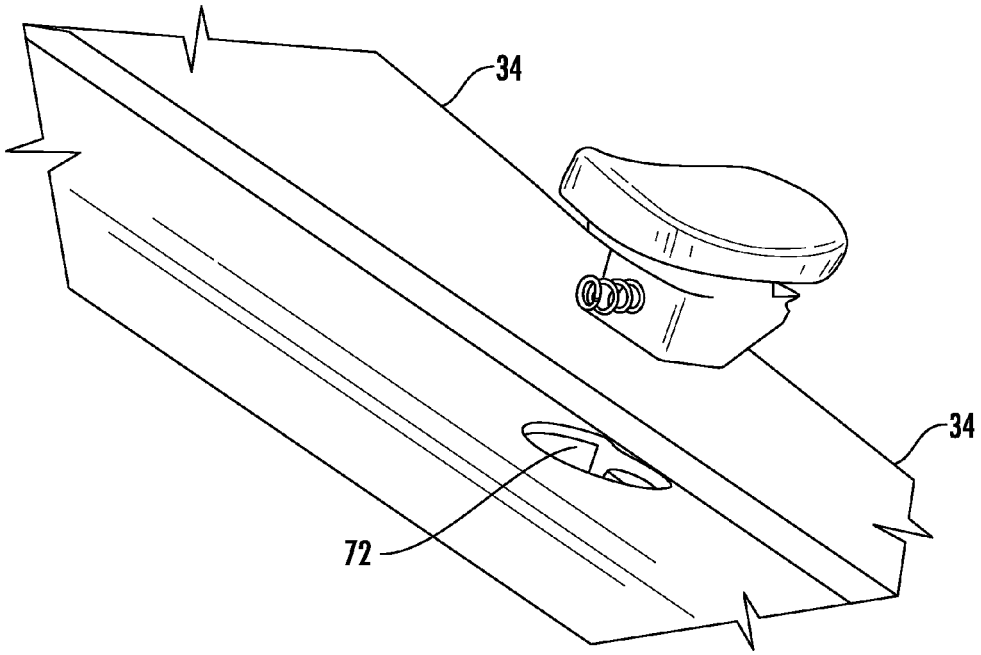
FIG. 9 is an isometric partially-exploded view of the lineal component of FIG. 6 and the latch component of FIG. 8 positioned relative to one another prior to coupling.
Figure 10:
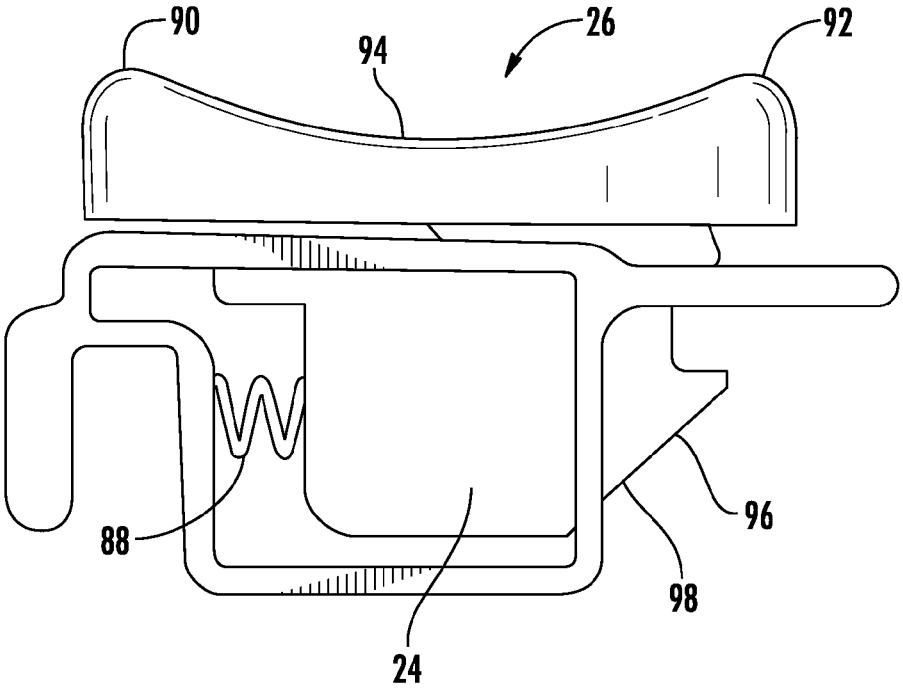
FIG. 10 is an end view of the lineal component of FIG. 6 coupled to the latch component of FIG. 8.
Figure 11:
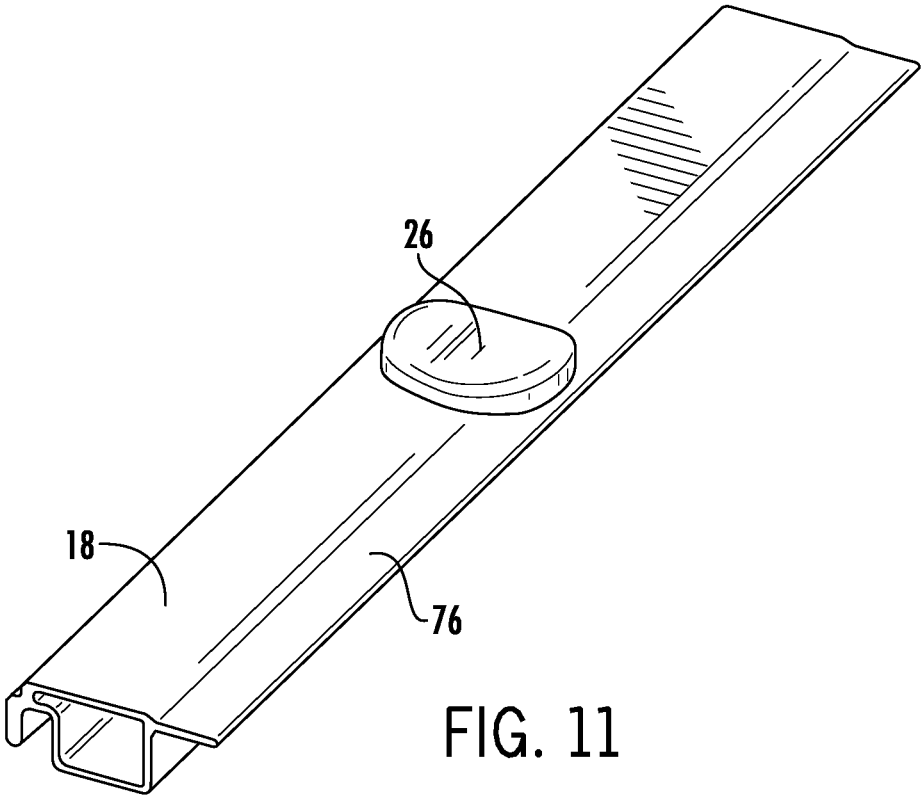
FIG. 11 is an isometric view of the lineal component of FIG. 6 coupled to the latch component of FIG. 8.

Referring to FIGS. 6-11, latch member 24 is removably coupled to lineal 22 intermediate first end 40 and second end 42. Referring to FIG. 9 latch member 24 is positioned relative to lineal 22 in preparation for coupling. Referring to FIGS. 10 and 11 latch member 24 is coupled to lineal 22. In preparation for coupling, latch mechanism 10 is oriented above first opening 72 with latch member 24 proximate first opening 72, with nose 102 pointing toward lineal extension 76 and with spring 88 pointing toward spline groove 80. Manipulation of latch mechanism 10 during coupling occurs substantially by manipulation of handle 26, wherein latch member 24 is inserted into cavity 70 through first opening 72. During coupling, engagement region 96 engages second opening 74, groove 120 receives a portion of lineal extension 76, and retaining groove 110 receives a portion of wall 46 of lineal 22. Spring 88 contacts and/or engages interior surface 66 of fourth wall 64. When fully coupled, spring 88 is compressed by contact with fourth wall 64, thereby biasing engagement region 96 through second opening 74 until contact between wall 122 of groove 120 and lineal extension 76 prevents further movement.

In one embodiment of coupling latch mechanism 10 with lineal 22, prior to insertion of latch mechanism 10 into cavity 70, latch mechanism 10 is tilted or twisted to point the free end of spring 88 toward first opening 72, followed by twisting of latch mechanism 10 in rotating motion about an axis that is generally parallel to the longitudinal axis 36 of lineal 22. In this manner engagement region 96 extends through second opening 74 and lip groove 120 receives a portion of lineal extension 76.

In another embodiment of coupling latch mechanism 10 with lineal 22, prior to insertion of latch mechanism 10 into cavity 70, latch mechanism 10 may be twisted or rotated to point the free end of spring 88 generally toward one of lineal first end 40 and lineal second end 42, followed by twisting of latch mechanism 10 to allow engagement region 96 to extend through second opening 74 and lip groove 120 receives lineal extension 76.

In yet another embodiment of coupling latch mechanism 10 with lineal 22 a combination of twisting motions may occur. A first twisting motion as latch assembly is inserted through first opening 72 and followed by a second different twisting motion to insert engagement region 96 through second opening 74. In still another embodiment, latch mechanism is coupled to lineal 22 before screen 16 and spline 20 are received in spline groove 80.

Referring to FIGS. 10 and 11, with latch mechanism 10 coupled to lineal 22, handle first end 90 does not extend beyond spline flange 78 and handle second end 92 does not extend beyond a terminal edge of lineal extension 76.

Figure 12:
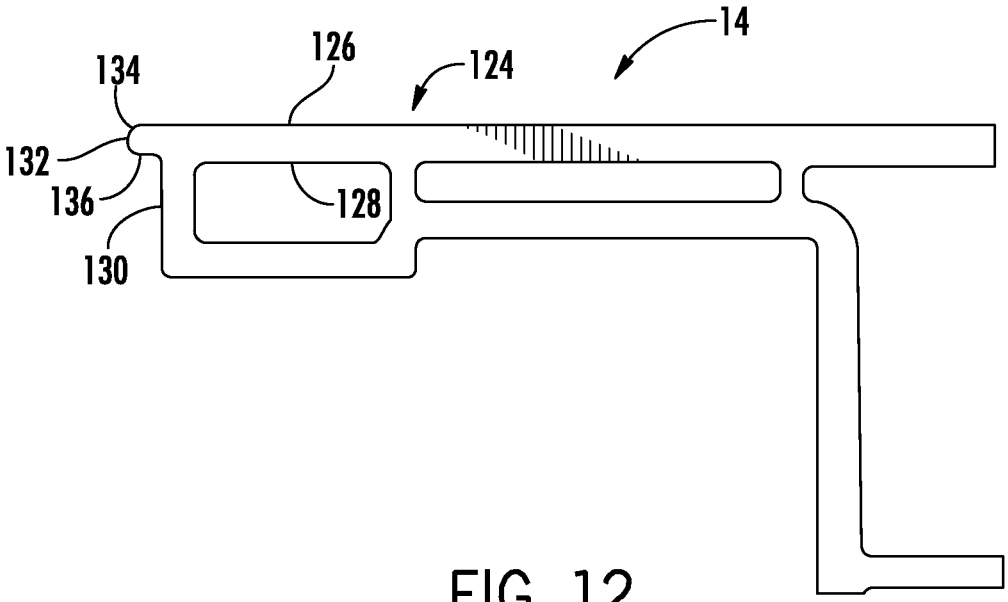
FIG. 12 is a cross-sectional view of an architectural frame component of the latch of FIG. 1 taken along lines 12-12 of FIG. 1.

Referring to FIG. 12, architectural frame 14 such as a window frame or door frame provides a structure to which screen assembly 12 is removably secured. Architectural frame 14 comprises a wall 124 including a first surface 126 and a second opposing surface 128. Second surface 128 is substantially parallel to first surface 126. Architectural frame 14 includes a third surface 130, the third surface 128 substantially perpendicular first surface 126 and second surface 128. A frame lip 132 extends from the interface of wall 124 and third surface 130. In one embodiment, lip 132 is substantially coplanar with wall 124 and substantially perpendicular to third surface 130. In another embodiment, lip 132 may be spaced from and substantially parallel to wall 124.

Referring to FIGS. 2, 7, 8, 10 and 12, screen assembly 12 is removably secured to architectural frame 14. In preparation for securement, screen assembly 12 is positioned relative to architectural frame 14 with lineal extension 76 proximate frame wall 124 with first side 138 of lineal extension 76 facing first surface 126 of wall 124.

Latch mechanism 10 is located within lineal 22 in the extended unlocked position. In this orientation, ramp 98 of latch member 24 abuts a first surface 134 of lip 132. As a user exerts a force against screen assembly 12 generally toward architectural frame 14 to create movement of lineal extension 76 toward frame wall 124, latch member 24 is forced inwardly into lineal 22 in vector direction 28 thereby compressing spring 88. Retaining portion 86 and handle 26 correspondingly move with latch member 24 in vector direction 28 with handle 26 sliding along vector direction 28 away from lineal extension 76. Latch member 24 will continue to travel toward wall 64 of lineal 22 until nose 102 of ramp 98 clears the free end of lip 132. Once nose 102 clears the free end of lip 132 the spring force of spring 88 biases latch mechanism 10 away from wall 64 in toward frame 14 until rear wall 122 of groove 120 contacts the leading edge of first opening 72 in lineal 22. In this engaged position, extension member 76 is located proximate surface 134 of lip 132 and nose 102 is proximate surface 136 of lip 132. In this manner screen assembly 12 is secured to architectural frame 14. The compressive force of spring 88 maintains latch member 24 proximate surface 136 of extension 132 of architectural frame 14.

Figure 2:
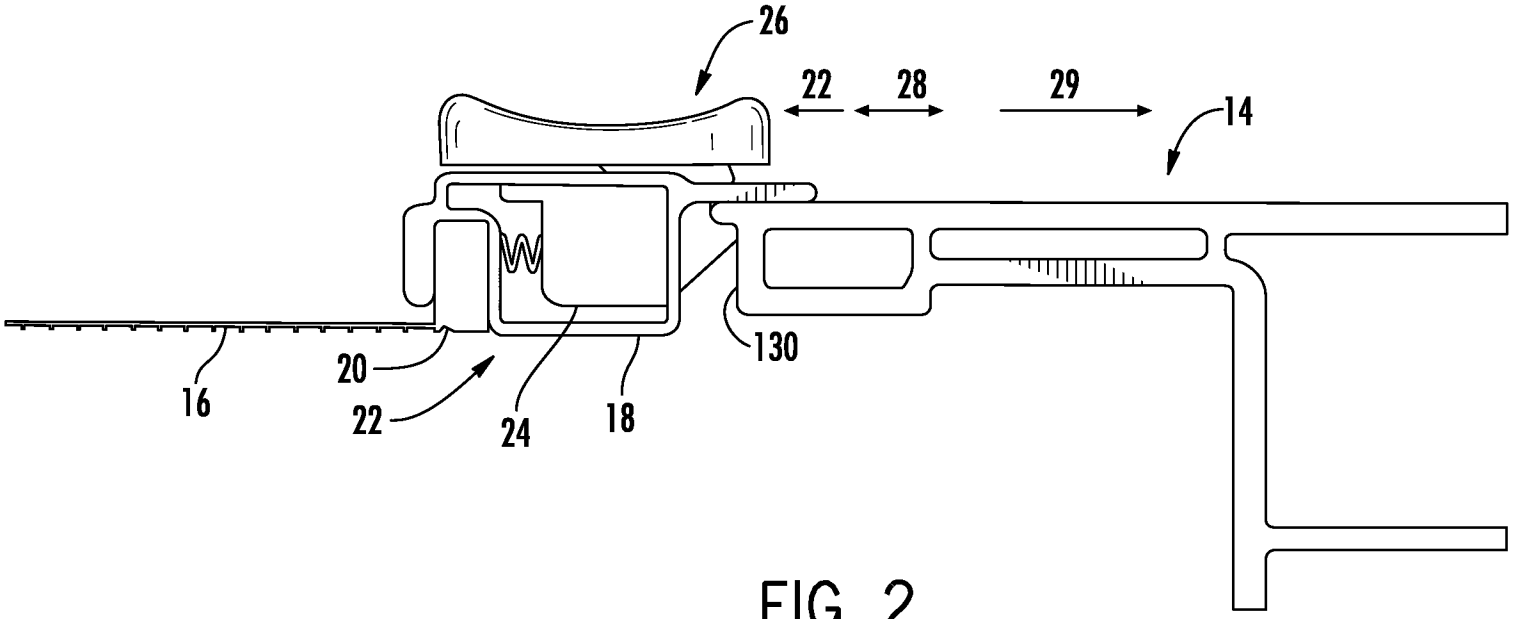
FIG. 2 is a cross-sectional view of the latch mechanism of FIG. 1 in an engaged position taken along lines 2-2 of FIG. 1.

Referring to FIG. 2, nose 102 extends a distance beyond the free edge of lip 132 toward wall 130 of architectural frame 14. This overlap provides for both a secure latch of screen assembly 12 to architectural frame 14. In one embodiment, by design, wall 122 of groove 120 extends an adjustment distance beyond wall 58 of lineal 22. This distance allows for variability in the gap between screen assembly 12 and architectural frame 14 when screen assembly 12 is secured to architectural frame 14. The adjustment distance or range is defined as the distance between surface 62 of third wall 58 of lineal 22 and wall 130 of frame 14. This adjustment range varies relative to dimensional differences between screen assembly 12 and architectural frame 14 and provides a range of adjustment for positioning of screen assembly 12 relative to architectural frame 14.

Referring to FIG. 1, two or more latch mechanisms 10 are secured to opposite vertical lineals 22. As screen assembly 12 is positioned in architectural frame 14, spring 88 of each of the latch mechanisms will assist in centering screen assembly 12 within architectural frame 14 between the two vertical members of architectural frame 14. Similarly, referring to FIG. 2, two or more latch mechanisms may be secured to opposite horizontal lineals. In this embodiment, springs 88 of each of the opposing latch mechanisms in the horizontal lineals will assist in centering screen assembly 12 in the vertical direction.

In another embodiment, screen assembly 12 comprises a quantity of lineals 22, the quantity of lineals 22 including, but not limited to, four and a quantity of latch mechanisms 10, the quantity of latch mechanisms 10 including, but not limited to, four. The quantity of lineals 22 are configured to form a screen frame 18 of a shape including, but not limited to, a rectangle with one or more latch mechanisms 10 being coupled to each lineal 22. Opposing forces exerted by latch mechanisms 10 substantially center screen assembly 12 relative to architectural frame 14.

Referring to FIG. 2 screen assembly 12 is secured to architectural frame 14 in an engaged position. To disengage screen assembly 12 from architectural frame 14, external force is exerted on handle 26 in vector direction 28 away from architectural frame 14 toward screen 16 moving handle 26 and latch member 24 inboardly and compressing spring 88 until spring wall 106 moves toward lineal fourth wall 64 and latch member 24 is disengaged from frame 14. Referring to FIG. 3 latch member 24 is in the disengaged position and no longer in contact with lip 132 of architectural frame 14.

The term lock as used in this application refers to fixing the position of the latch mechanism 10 in a disengaged position with respect to lineal 22 such that latch member 24 will not engage architectural frame 14 when screen assembly 12 is pressed against architectural frame 14. Referring to FIG. 4, latch mechanism may be moved to a locked position once catch surface 100 moves through second opening 74. Once catch surface 100 moves through second opening toward wall 64, latch mechanism 10 may be rocked to a locked position. When a user applies a force on handle first end 90 toward lineal spline groove 80, latch mechanism 10 rocks or rotates about its axis 34 until latch catch surface 100 catches or engages lineal third wall 58 intermediate lineal first wall 46 and lineal second opening 74. In the locked position, latch retaining member 108 is located within lineal retaining groove 82 and latch catch surface 100 proximate nose 102 is engaged with a peripheral portion of second opening 74. Force exerted by spring 88 maintains contact between catch surface 100 and third wall 58, thereby maintaining latch mechanism 10 in the locked position. In one embodiment, spring 88 contacts wall 106 biasing latch member 24 about axis 34 such that first end 90 of handle 26 is closer to wall 46 than second end 92 of handle 26. With latch mechanism 10 in the locked position, screen assembly 12 may be removed from architectural frame 14 without any interference of latch member 24.

To unlock latch mechanism 10, to allow latch mechanism to extend to an engaged position, an external force is exerted on handle second end 92 toward lineal extension 76, as a result, latch mechanism rocks about pivot axis 34 in a second direction opposite to the first direction when latch mechanism was rocked to the locked position. Referring to FIG. 5, as latch mechanism rocks about pivot axis in the second direction latch notch surface 100 disengages lineal third wall 58 and extends through second opening 74. As the external force applied by a user on handle 26 is released, the force exerted by spring 88 moves latch member 24 outboardly in vector direction 28, such that latch member 98 extends through second opening 74. In this unlocked orientation, screen assembly 12 may be secured to architectural frame 14 as discussed above. It should be noted that if screen assembly 12 is in place against extension member 76 of frame 12, latch member 24 moves directly to the engaged position when latch mechanism is unlocked thereby securing screen assembly 12 to architectural frame 14, without the need to engage ramp or beveled surface or ramp 98 against lip 132 of architectural frame 14.

In another embodiment, screen assembly 12 is positioned to architectural frame 14 prior to release of latch mechanism 10 from the disengaged and locked position. In this position once lineal extension 76 contacts surface 126 of frame wall 124 a user may release the latch mechanism as discussed above. The force of spring 88 will move latch member 24 outboardly in vector direction 28 until reaching the engaged position.

Referring to FIG. 4, in another embodiment latch mechanism 10 may be rocked to a lock position by rotating latch mechanism 10 about axis 34 is a second direction opposite the first direction. In this embodiment, engagement surface 118 engages a peripheral edge of first opening 72. To release the latch mechanism in this embodiment, the handle 26 is rocked in the first direction to release engagement surface 118 from the first opening 72, allowing the latch member 24 to extend through the second opening 74 by spring 88.

Figure 13:
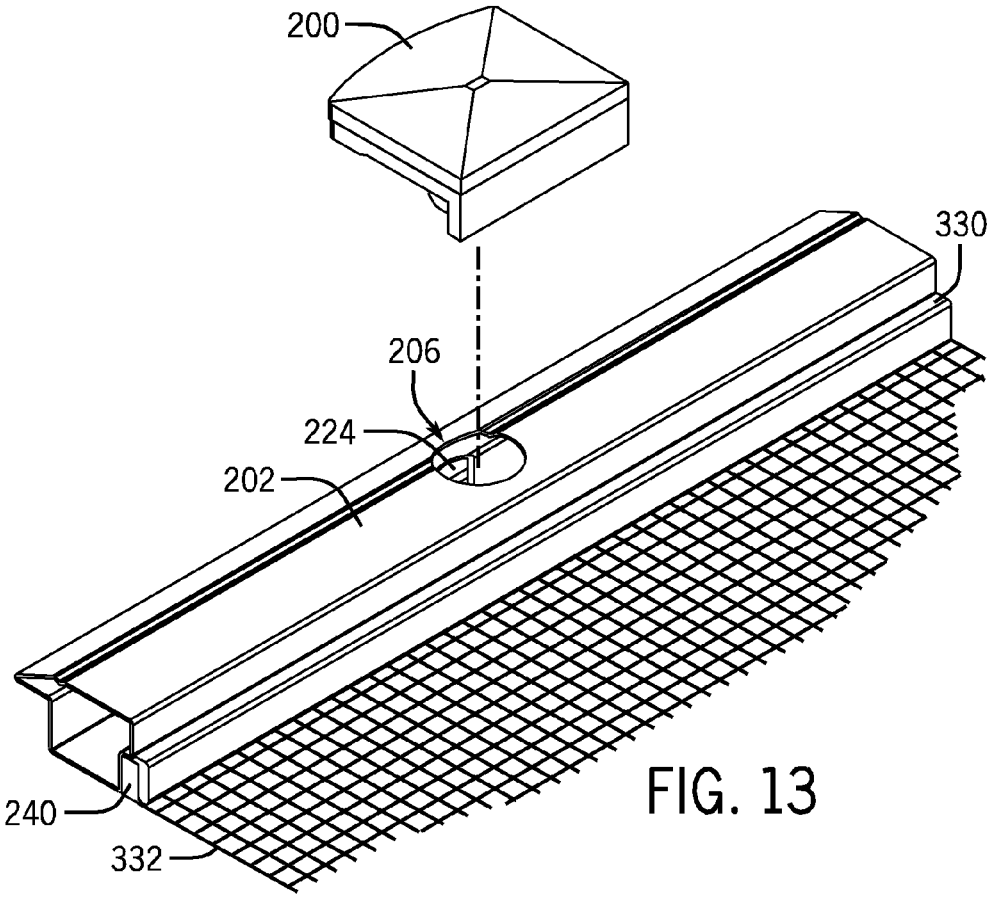
FIG. 13 is a top angle view of the total latch assembly aligning for insertion into a screen lineal.

Referring to FIG. 13 another embodiment of a latch assembly 200 is used with a screen assembly including a plurality of screen lineal members 202. Screen lineal members 202 forms the border a four sided screen frame 204. However, a screen frame may be formed with any number of sides. Screen lineal 202 includes at least one top aperture 206 through which latch assembly is inserted thorough. Top aperture 206 may be predrilled at a factory or a user may drill the top aperture 206 in the field when the screen frame 204 is being assembled. As discussed below, any resulting burrs adjacent aperture 206 will be covered. In one embodiment top aperture 206 is approximately ⅜ of an inch in diameter; however other aperture diameters are also contemplated.

Figure 14:
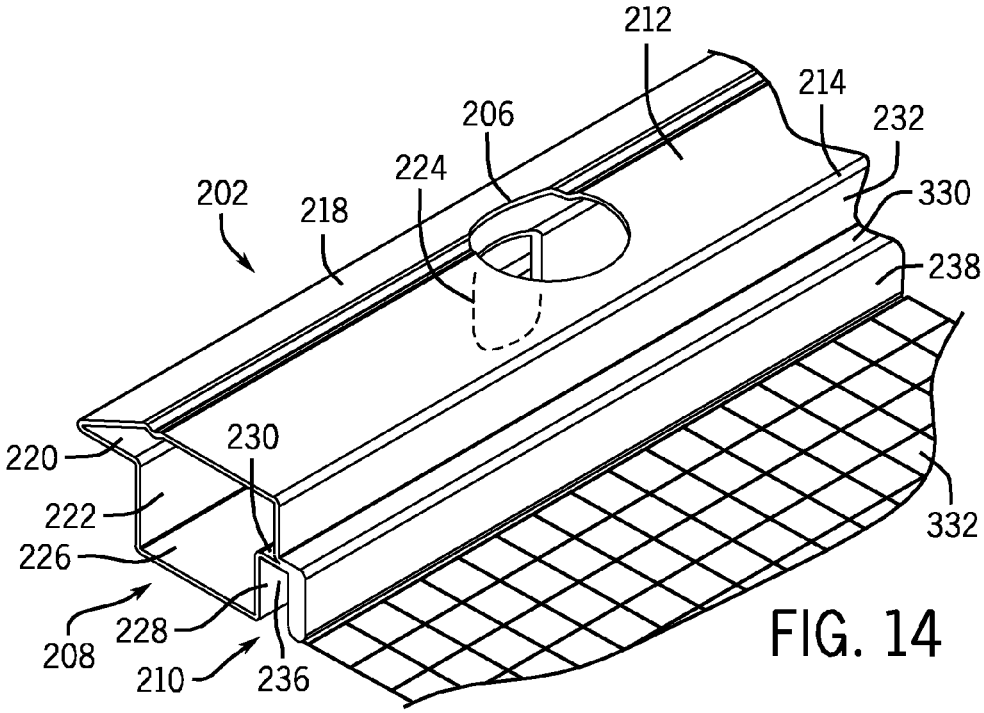
FIG. 14 is a side view of a screen lineal.

Referring to FIG. 14 each screen lineal 202 includes a plurality of walls that form a tunnel 208 and a channel 210. Lineal 202 may be an extruded member having terminal ends that may be open at both ends, closed at either end or closed at both ends. Screen lineal 202 includes a flat top surface 212 that faces away from a window that is covered by the screen assembly. The flat top surface 212 is substantially parallel with a screen member 16. In one embodiment aperture 206 is located on aperture 206 may be positioned between the terminal ends of lineal 202. For example, with one aperture 206 located on each lineal 202 per side, the top aperture 206 is placed in the center position between the two terminal ends of lineal 202. If there were two apertures 206 per lineal member 202, the apertures 206 could be positioned at the one third and two thirds mark respectively from one terminal end of lineal 202.

Extending from flat top surface 212 is an inclined surface 218. Inclined surface 218 extends from top surface 212 in a direction towards a plane created by screen member 16. The angle formed between flat top surface 212 and inclined surface 218 is approximately 150°, of course other angles are contemplated. Inclined surface 218 is connected to a lip surface 220 that is essentially parallel to the flat top surface 212 and the screen member 16. The angle formed by the lip surface 220 and inclined surface is approximately 30°.

Lip surface 220 is connected to a first vertical wall 222 extending in a direction away from top surface 212. The angle formed between lip surface 220 and the first vertical wall 222 is 90°. The first vertical wall 222 has a side aperture 224 formed therethrough that lines up with the top aperture 206. A bottom floor member 226 is connected to the first vertical wall 222 and extends nearly parallel to top surface 212 and screen member 16. The angled created by the floor member 226 and first vertical wall 222 is approximately 90°. Floor 226 is connected to a second vertical wall 228. The angle created by floor 226 and second vertical wall 228 is approximately 90°. Second vertical wall is substantially parallel to first vertical wall 222. Second vertical wall 228 is connected to an elevated floor wall 230. The elevated floor wall 230 is parallel to the tunnel floor 226, approximately ½ the distance between floor 226 and top surface 212. The elevated floor wall 230 extends perpendicular to floor 226. The elevated floor wall 230 is connected to a third vertical wall 232. The third vertical wall 232 extends 90° from elevated floor wall 230 towards flat top surface 212. The third vertical wall 232 and the flat top surface 212 are connected at an edge 214 of top surface 212 and form a 90° angle.

Channel 210 is defined by second vertical wall 228, elevated floor wall 230 and third vertical wall 232 and includes an opening through which an edge of screen member 16 is secured. A pliable member or screen spline 240 is located within channel securing screen member 16 within the channel 210.

Channel 210 comprises the second vertical wall 228 connected to a channel top surface 236 at approximately 90°. The channel top surface 236 is connected to a third vertical wall 238 at approximately 90°. Within the channel 210, there is a rectangular block or screen spline 240. The screen spline 240 is approximately the height the second vertical wall 228 and the third vertical wall 238.

Figure 15:
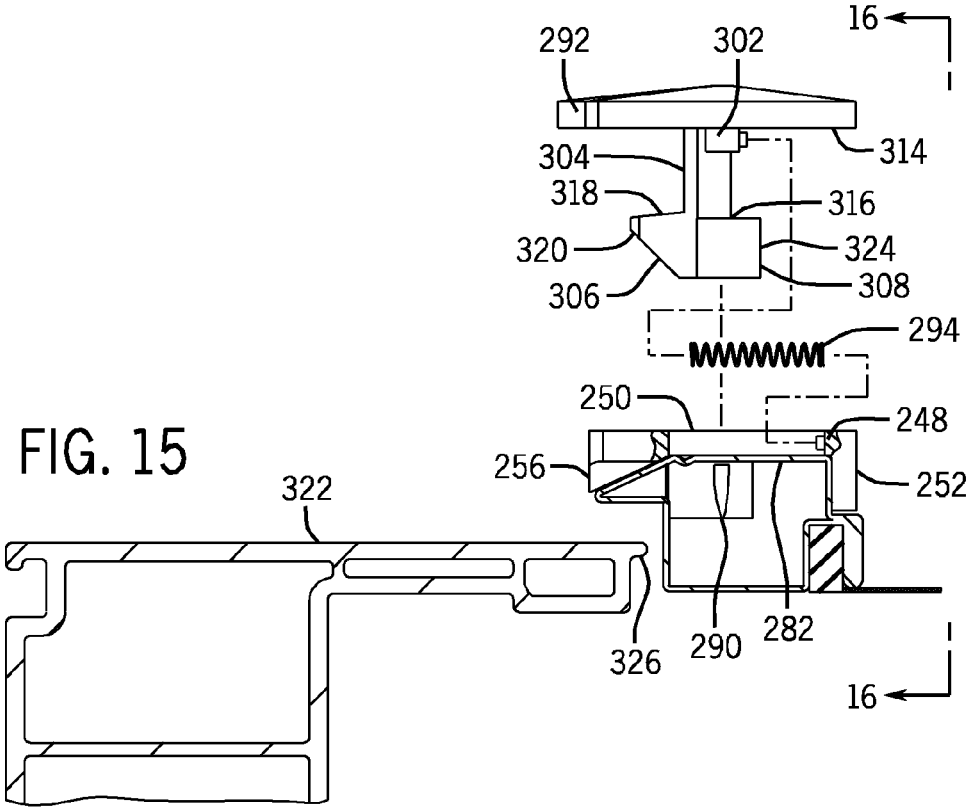
FIG. 15 is a side view of a shield installed with a slide aligned to be installed.
Figure 16:
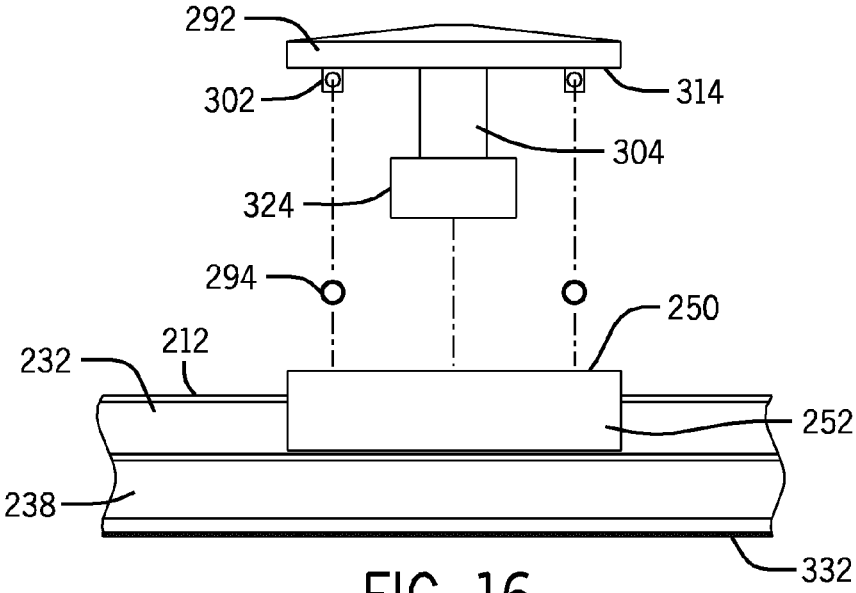
FIG. 16 is an exploded rear view of the latch assembly.
Figure 17:
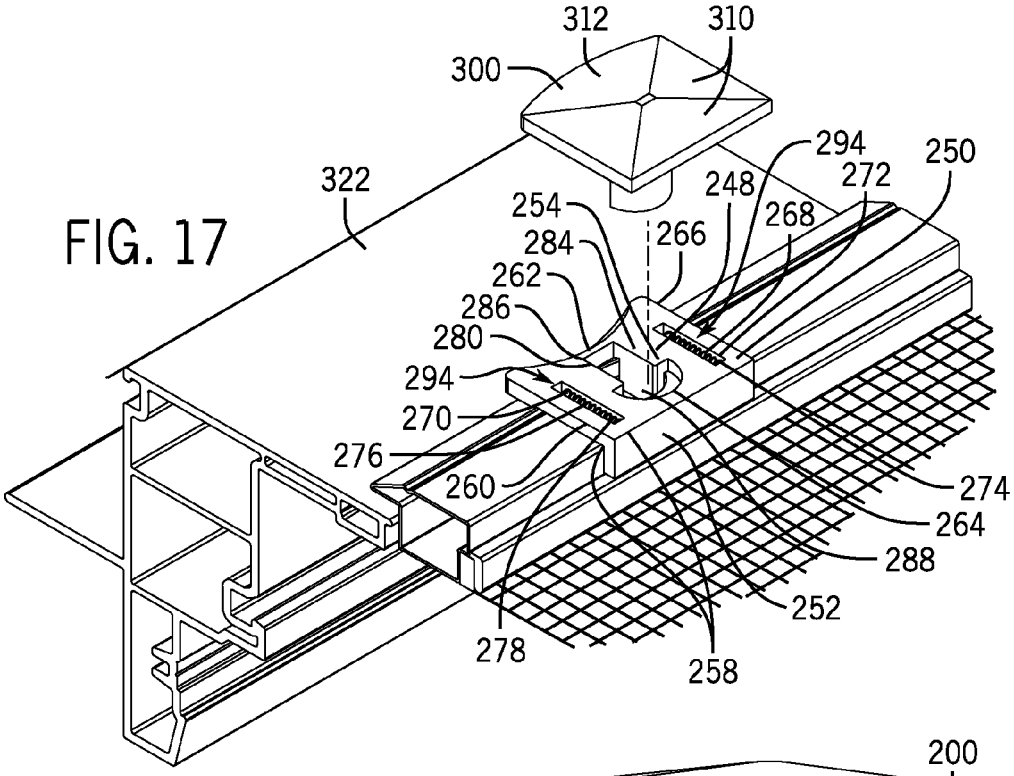
FIG. 17 is a top angled view of a shield installed with a slide aligned to be installed.
Figure 18:
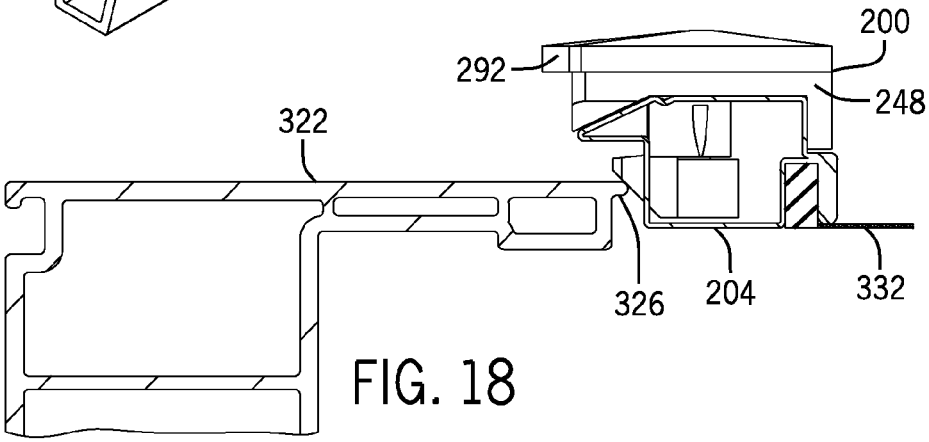
FIG. 18 is a side view of the screen frame and latch assembly prior to being engaged with a window frame.
Figure 19:
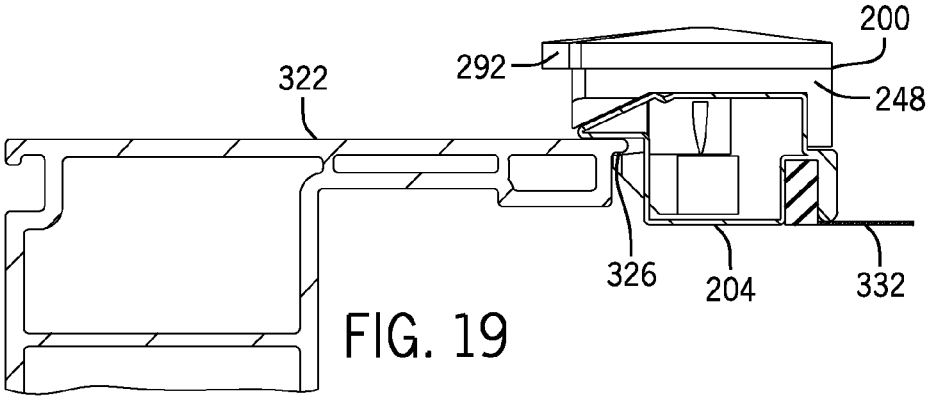
FIG. 19 is a side view of the screen frame and latch assembly engaged with a window frame.

Referring to FIGS. 15-17 a shield 248 is mounted on the flat top surface 212 of the screen lineal 202. Shield 248 includes a horizontal panel 250, a vertical panel 252 and a half cylinder backstop 254. Horizontal panel 250 and the vertical panel 252 form an L-shape member. Extending from horizontal panel 250 in a direction away from a top surface of horizontal panel is a triangular portion 256 that mates with the slope portion of inclined surface 218.

The horizontal panel 250 comprises a first edge 258 that is adjacent to vertical panel 252 and is parallel to the longitudinal axis of screen lineal member 202. Horizontal panel 250 includes a second edge 260 that is perpendicular to first edge 258. A third edge 262 extends from second edge toward a fourth edge 266 that is parallel to second edge 260 and perpendicular to first edge 258. In one embodiment third edge 262 has an concave arcuate shape where tangent of a center point 264 of curved third edge 262 is parallel to first edge 258.

In one embodiment horizontal panel 250 includes three apertures, two of which have a bottom forming a first cavity 268 and the second cavity 270 both of which are rectangular, at a length to width ratio of approximately 5:1. A first edge 272 of the first cavity 268 is proximate third edge 262. A width edge 274 of the cavity 268 is proximate first edge 258. A first length edge 276 of second cavity 270 is proximate second edge 260. A width edge 278 of second cavity 270 is proximate the first edge 258.

A third aperture 280 of shield 248 is mushroom shaped with a first arcuate or mushroom head portion and a second stem or generally rectangular portion. Both the arcuate portion and the second portion are located between first channels 266 and second channel 270. The imaginary line of the mirror center 272 of the mushroom shaped aperture 280, crosses the center point 264 of the third edge 262 of the horizontal panel 250 of shield 248.

The half cylinder backstop 254 extends through third aperture 280. Half cylinder backstop 254 is extends downward beyond a bottom side 282 of horizontal panel 250. On the vertical wall 288 of the half cylinder backstop 254 is a V-shaped guidepost 290. The V-shaped guidepost 290 is used to mount a top slide 292.

A spring 294 is located within first channel 268 and a second spring 294 is located within second channel. The two springs 294 provide for the extension of top slide 292 away from screen member 16.

In one embodiment top slide 292 includes a cap 300, a pair of spring bosses 302, a vertical shaft 304, and a latch 306. Latch 306 includes a beveled surface 306 and a front stop 308. In one embodiment, cap 300 comprises three standard equilateral triangles 310 and an equilateral triangle with a curved side 312 that is not an equilateral side. The physical shape of cap 300 may be of any shape, preferably a design that is comfortable for a user's finger and/or hand.

The pair of spring bosses 302 is mounted underneath the four sided pyramid cap 300. Each spring boss 302 is configured to engage one end of a respective spring 294.

A vertical shaft 304 is center mounted on the bottom side 314 of the four sided pyramid cap 300. Latch 306 is connected to the bottom side 316 of the vertical shaft 304. Latch portion 320 points towards the window frame 322 and away from the screen frame 16.

In one embodiment front stop 308 has an arcuate shape that matched the arcuate opening of center aperture 280. The attachment of the top slide 292 to shield 248 comprises orienting right latch 306 towards aperture 280 of horizontal panel 250. Latch 306 and the vertical shaft 304 are inserted into aperture 280 such that the latch 320 points towards the window frame 322 and away from the screen 16. The combination of the top slide 292 and the shield 248 comprise the latch assembly 200. The resulting latch assembly 200 is shown in FIG. 17. In operation vertical shaft 304 moves within the rectangular portion of center aperture 280, while front stop 308 moves under shield 248.

In one embodiment, the bottom side 314 of top slide 292 may contain two ribs 328. These ribs 328 are designed to fit into the two pits 268, 270 to hold springs 294 in place. As used herein the term snap-fit or snap-fitting is defined as:

A mechanical joint system where part-to-part attachment is accomplished with locating and locking features (constraint features) that are homogenous with one or the other of the components being joined. Joining requires the (flexible) locking features to move aside for engagement with the mating part, followed by return of the locking feature toward its original position to accomplish the interference required to latch the components together. Locator features, the second type of constraint feature, are inflexible, providing strength and stability in the attachment.

Replacing or inserting a screen frame 204 is a relatively simple process. If the latch assembly 200 is not already in place, there are three ways to attach the latch assembly 200. The first method, a user may simple purchase a latch assembly 200 already assembled. The user would snap-fit the latch assembly 200 into each aperture(s) 206 of the screen lineal(s) 204. A second method, a user may snap-fit a top slide 292 with a shield 248 and then snap-fit this assembly 200 into the aperture(s) 206 of the screen lineal(s) 204. A third method would be to insert or snap-fit the shield 248 into the aperture (s) 206 of the screen lineal(s) 204. Then, a user may snap-fit the top slide 292 into the shield 248.

In general, when latch assembly 200 is located in top aperture 206, vertical panel 252 rests on top of a screen side lip 330. The horizontal panel 250 rests on the top surface 212 of lineal 202. To release screen frame from window structure, a user slides top slide 292 towards the screen 16. This action moves the latch through side aperture 224 of lineal 202, away from a window frame lip 326. Once the latch clears the frame lip 326, the screen frame 204 automatically releases the window frame. At this point, the screen 332 can be replaced. When the screen frame 204 is inserted, the window frame lip 326 interacts with the pointed end 320 of the right angle latch 306. The latch 306 in one embodiment is formed from a right angle trapezoid blade moves back through side aperture 224, toward and making contact with the window frame lip 326. The force exerted on the right angle trapezoid blade 306 from the screen frame 204 insertion in combination with springs 294, forces the top slide 292 to slide back into closed or locked position. Springs 294 also counteract any loosening forces due to vibration or window operation.

It is important to note that the construction mechanism as described herein is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A window screen assembly comprising:

a screen frame including at least one lineal member having a screen channel and at least one aperture positioned between a first end and a second end of the lineal member;

a screen member secured in the screen channel; and a spring biased latch assembly located within the aperture, the spring biased latch assembly having a latch portion biased in a direction away from the screen channel, a shield member with a first portion located on a top surface of the lineal member and a second portion extending through the aperture and a slide having a top portion located above the shield and a beveled latch member extending from a bottom of the top portion;

wherein the shield is located between the top portion of the slide and the top surface of the lineal member, wherein the top surface of the lineal member is intermediate the top portion of the slide and the beveled latch member.

2. The window screen assembly of claim 1 wherein, the latch assembly includes a spring located in the shield to bias the latch in a direction away from the screen member.

3. The window screen assembly of claim 2 wherein, the lineal member includes a channel formed below the top surface and including a second aperture formed in a wall extending substantially perpendicular to the top surface of the lineal member, the latch being biased by the spring to extend through the second aperture in a direction away from the screen member.

4. The window screen assembly of claim 1 wherein the window screen assembly is configured to be removeably secured to an architectural member.

5. The window screen assembly of claim 1 wherein, the lineal member includes an extension lip portion extending in a direction away from the screen channel, the beveled latch member being configured to engage a first side of an architectural frame lip and the extension lip portion being configured to engage an opposing second side of the architectural frame lip.

6. The window screen assembly of claim 1, wherein the slide assembly when attached to the screen lineal completely covers the first aperture.

7. The window screen assembly of claim 6, wherein the slide assembly attachment is secured within the aperture with a snap fit.

8. The window screen assembly of claim 2, wherein the springs bias spring bosses located on the top portion of the slide biasing the latch in a direction away from the screen member.

9. The window screen assembly of claim 7, wherein the shield contains at least one spring which provides perpendicular stability of the slide assembly with respect to the spring bosses.

10. The window screen assembly of claim 1, wherein the aperture is located in the center of the lineal member between the first end and second end of the lineal member.

11. A window screen assembly comprising:

a frame including at least one lineal member having an outer edge, an opposing inner edge, a top surface and an opening extending through the lineal member intermediate the outer edge and inner edge;

a screen member coupled to the lineal member proximate an inner edge;

a latch mechanism including a shield having a top portion adjacent the top surface and a bottom portion extending through the aperture and operatively secured to the lineal member, a handle slidably mounted on the shield, the shield substantially covering the periphery of the aperture, the handle including a top portion located above the top surface of the shield and a latch portion secured to the handle with a stem extending through the aperture;

a first spring located in the shield between the top portion of the handle and the top surface of the lineal member, the spring biasing the handle in a direction perpendicular to the longitudinal axis of the lineal member from the inner edge toward the outer edge.

12. The window screen assembly of claim 11, wherein the installation of the assembly is independent of the attachment of the screen member.

13. The window screen assembly of claim 11, wherein the assembly does not interfere with the viewing area of the screen member.

14. The window screen assembly of claim 11, wherein installation of the assembly does not require tools.

15. The window screen assembly of claim 11, wherein the assembly is securely held with only one latch per screen member side.

16. A window screen assembly of claim 11, wherein the latch mechanism is attached to the lineal member with a snap-fit.

17. The window screen assembly of claim 11, wherein the assembly includes a second spring, the stem being positioned between the first spring and the second spring.

* * * * *